US010856378B2

(12) United States Patent
Ma

(10) Patent No.: US 10,856,378 B2
(45) Date of Patent: Dec. 1, 2020

(54) INTELLIGENT POWER SUPPLY AND AUXILIARY MONITORING METHOD FOR INTELLIGENT POWER SUPPLY

(71) Applicants: Self Electronics Co., Ltd., Zhejiang (CN); Wanjiong Lin, Zhejiang (CN); Self electronics USA Corporation, Norcross, GA (US)

(72) Inventor: Xuhong Ma, Zhejiang (CN)

(73) Assignees: Wanjiong Lin, Ningbo (CN); Self Electronics Co., Ltd., Ningbo (CN); Self Electronics USA Corp., Ningbo (CN)

( * ) Notice: Subject to any disclaimer, the term of this patent is extended or adjusted under 35 U.S.C. 154(b) by 0 days.

(21) Appl. No.: 16/426,955

(22) Filed: May 30, 2019

(65) Prior Publication Data

US 2019/0372342 A1 Dec. 5, 2019

(30) Foreign Application Priority Data

May 31, 2018 (CN) ..... 2018 1 0553579

(51) Int. Cl.

| | |
|---|---|
| ***H05B 45/34*** | (2020.01) |
| ***H05B 47/10*** | (2020.01) |
| ***H05B 45/37*** | (2020.01) |
| ***H05B 45/10*** | (2020.01) |

(52) U.S. Cl.

CPC ..... *H05B 45/10* (2020.01); *H05B 45/34* (2020.01); *H05B 45/37* (2020.01); *H05B 47/10* (2020.01)

(58) Field of Classification Search

CPC ..... H05B 45/10; H05B 45/14; H05B 45/34; H05B 45/35; H05B 45/357; H05B 45/37; H05B 45/3725; H05B 45/50; H05B 47/10; H05B 39/041; H05B 39/044; H05B 39/045; H05B 39/047

See application file for complete search history.

(56) References Cited

U.S. PATENT DOCUMENTS

2002/0011807 A1* 1/2002 Kobayashi ..... H05B 41/2813 315/291

2018/0192485 A1* 7/2018 Beij ..... H05B 45/395

* cited by examiner

*Primary Examiner* — Gary L Laxton

(74) *Attorney, Agent, or Firm* — Wang Law Firm, Inc.

(57) ABSTRACT

An intelligent power supply includes: constant current/constant voltage module; dimming control module which is located at a rear end of the constant current/constant voltage module and is electrically connected thereto; switching circuit for electrically connecting the constant current/constant voltage module and load, which is controlled by the dimming control module; the intelligent power supply further including voltage sampling module disposed between the constant current/constant voltage module and the dimming control module; and the power supply voltage of the voltage sampling module is provided by the constant current/constant voltage module, and the dimming control module detects the voltage signal of the sampling resistance of the voltage sampling module in real time; the operating power of the dimming control module is provided by the power supply voltage of the voltage sampling module.

8 Claims, 3 Drawing Sheets

INTELLIGENT POWER SUPPLY AND AUXILIARY MONITORING METHOD FOR INTELLIGENT POWER SUPPLY

RELATED APPLICATION

This application claims priority to Chinese Patent Application No. CN 201810553579.2, filed on May 31, 2018.

FIELD OF THE TECHNOLOGY

The present invention relates to electronic equipment field, with particular emphasis on a Intelligent power supply and auxiliary monitoring method for intelligent power supply.

BACKGROUND OF THE INVENTION

As lighting equipment becomes more and more intelligent, lighting control and scene lighting requirements are getting higher and higher. In order to meet such demand, more and more dimming power products are appearing on the market.

Generally, the power supply of dimming signal receiving, sampling, output controlling circuit comes from the ACDC control chip power supply, the introduction of dimming control signal and the output of the original side power supply make the control mode of dimming power supply also change, so some new problems are introduced.

For example, the control part of the circuit requires a higher operating current, and if it directly takes power from the ACDC control chip, then it will cause the ACDC to fail to start. In order to ensure the normal operation of the system, it is often necessary to add additional circuits to take power from the high voltage end, but this leads to complicated system setup; For TRAIC constant voltage dimming power supply, the PWM control of the duty cycle of the output will lead to the problem that at the minimum dimming angle the input voltage is too low and the chip cannot be started. In this case, if the control signal is connected to the system, the problem of output flicker will be inevitable. For this type of dimming power supply, when the output is short-circuited, the original side control chip is in the short-circuit protection mode, and the output-controlled MOS tube operates in the linear region, and the power consumption will be very high, which will lead to the failure of MOS tube if it lasts for a long time.

BRIEF SUMMARY OF THE INVENTION

In view of the above problems, an object of the present invention is to provide an intelligent power supply which can effectively avoid the output flicker caused by circuit instability and excessive loss when the circuit is abnormal.

Another object of the present invention is to provide an auxiliary monitoring method capable of monitoring and judging the working state of the intelligent power supply and adjusting the working mode of the circuit according to the judgment result.

In order to achieve the above purposes, the technical scheme of the invention is as follows: an intelligent power supply includes:

constant current/constant voltage module;

dimming control module, which is located at a rear end of the constant current/constant voltage module and is electrically connected thereto;

switch circuit for electrically connecting the constant current/constant voltage module and load, which is controlled by the dimming control module;

characterized in that:

the intelligent power supply further including voltage sampling module disposed between the constant current/constant voltage module and the dimming control module;

the power supply voltage of the voltage sampling module is provided by the constant current/constant voltage module, and the dimming control module detects the voltage signal of the sampling resistance of the voltage sampling module in real time;

the operating power of the dimming control module is provided by the power supply voltage of the voltage sampling module.

Advantageously, the voltage sampling module includes at least two resistors connected in series;

a detection port of the dimming control module is connected between the at least two series resistors for detecting the voltage drop of one of the sampling resistors, so as to judge the working state of the circuit according to the voltage drop to adopt a corresponding control mode.

Advantageously, the constant current/constant voltage module is an ACDC circuit, and the switch circuit includes MOS transistor or a bipolar transistor.

To avoid unstable voltage drop on the sampling resistors, advantageously, a filter capacitor is connected in parallel at both ends of the sampling resistor.

Advantageously, the working power supply end of the dimming control module is connected to the power supply voltage end of the voltage sampling module through an electrical branch formed by the stabilivolt and the triode;

the in-phase input end of the stabilivolt is connected to the voltage dividing resistor branch, and the output end is connected to the power supply voltage end of the voltage sampling module through a current limiting resistor, and the negative pole is grounded;

the base of the triode is connected to the output end of the stabilivolt, the collector is connected to the power supply voltage end of the voltage sampling module, and the emitter is connected to the working power supply end of the dimming control module.

An auxiliary monitoring method for intelligent power supply, the intelligent power supply adopting the structure as claimed in any one of claims 1 to 5, characterized in that the method comprises:

step S1: The dimming control module detects whether the power supply voltage of the voltage sampling module reaches a stable value;

step S2: If yes, step S3 is executed; If not, jump to step S1;

step S3: The dimming control module determines whether the power supply voltage of the voltage sampling module is stable and within a set range, and perform a corresponding operation.

Advantageously, in the step S3, the dimming control module determines whether the power supply voltage of the voltage sampling module is stable and is within a set range, and performs corresponding operations, specifically:

step A1: If it is determined that the power supply voltage of the voltage sampling module is stable and within the set range, step A3 is performed;

step A2: If it is determined that the power supply voltage of the voltage sampling module is unstable or not within the set range, then jump to step S1;

step A3: The dimming control module enters a normal working mode, controls the output, and starts the load short circuit timer at the same time.

Advantageously, the method further comprises performing the following operations after proceeding to step A3, step B1: Continue to monitor the power supply voltage of the voltage sampling module to determine whether it is reduced to a predetermined value;

step B2: If yes, perform step B3; if not, jump to step A3;

step B3: the dimming control module controls the switch circuit to turn off, close the output, and determine whether the current time of the load short circuit timer is less than the set value, and if so, step B4 is performed, if not, then jump to step S1;

step B4: Start a short circuit protection delay, and then jump to step S1.

Advantageously, the judgment whether the power supply voltage of the voltage sampling module reaches a stable value is specifically:

the detection port of the dimming control module acquires the voltage obtained by the sampling resistor of the voltage sampling module, according to the ratio of the resistance values of voltage sampling module, converting the obtained voltage to obtain a current power supply voltage of the voltage sampling module, and comparing the current power supply voltage with the stable value.

Compared with the prior art, the present invention has the advantages that the working voltage of the dimming control module is set to be the same as the power supply voltage of the voltage sampling module, so that the dimming control module can always be in the standby state at the start-up stage of the circuit. In this way, it can prevent the dimming control module from being connected to the system prematurely, and the output flicker caused by excessive current of constant current/constant voltage module can be avoided, which is highly efficient and convenient. In this way, the working voltage of the dimming control module changes synchronously with the power supply voltage of the voltage sampling module, and the dimming control module can switch to standby mode immediately when the circuit is abnormal or the working voltage is insufficient. and makes full use of the point that the dimming control module does not work and cannot provide a voltage sufficient for the switch circuit to start, thus the switch circuit is switched off, so that the connection between the constant current/constant voltage module and the load is rapidly disconnected, which reduces the switching circuit loss and protects the load safety.

BRIEF DESCRIPTION OF THE DRAWINGS

The drawings described herein are intended to promote a further understanding of the present invention, as follows.

DETAILED DESCRIPTION OF THE INVENTION

The present application is illustrated by way of the following detailed description based on of the accompanying drawings. It should be noted that illustration to the embodiment in this application is not intended to limit the invention.

Figure 1:
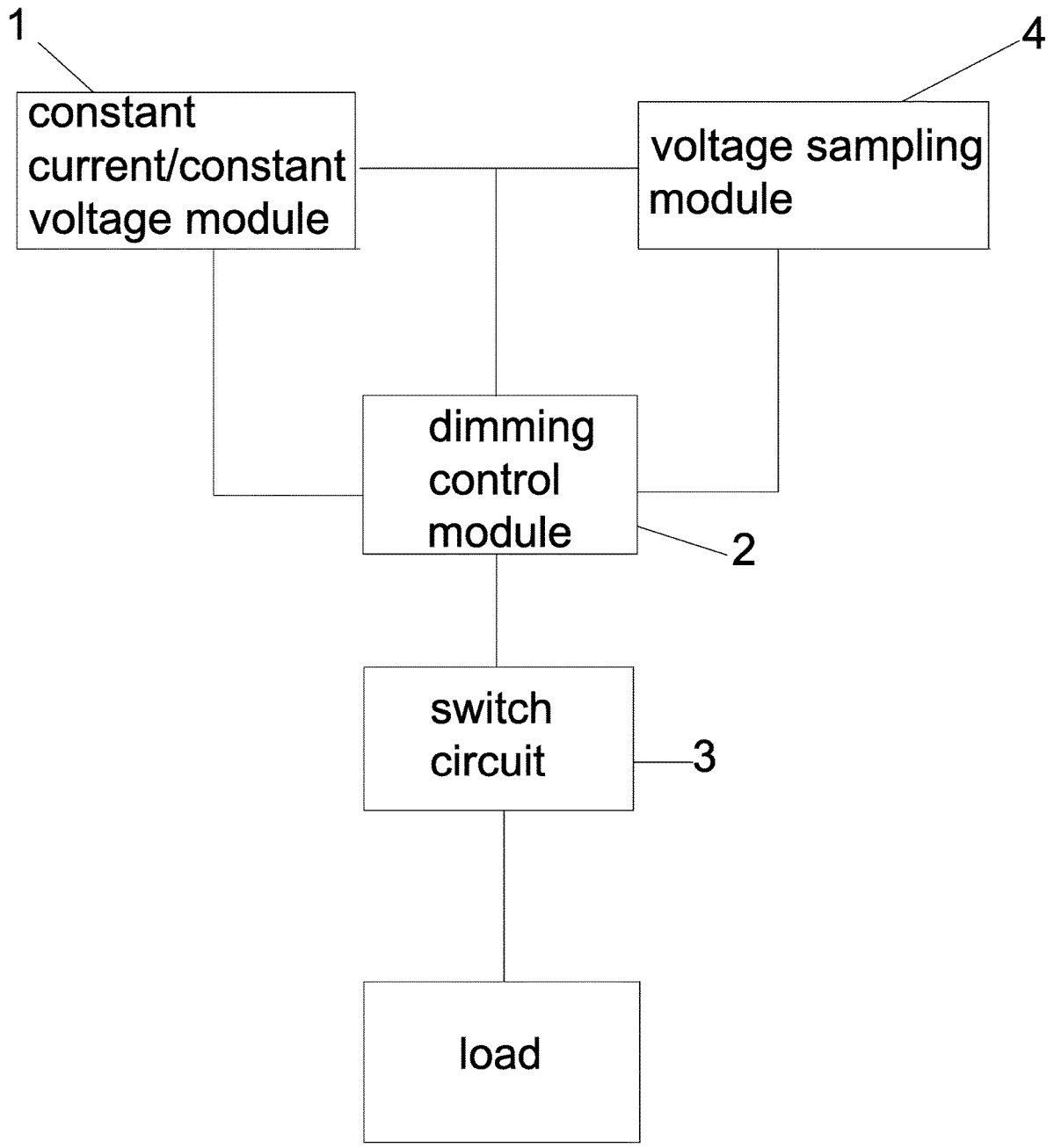
FIG. 1 is a structural schematic diagram of intelligent power supply of the present invention.
Figure 2:
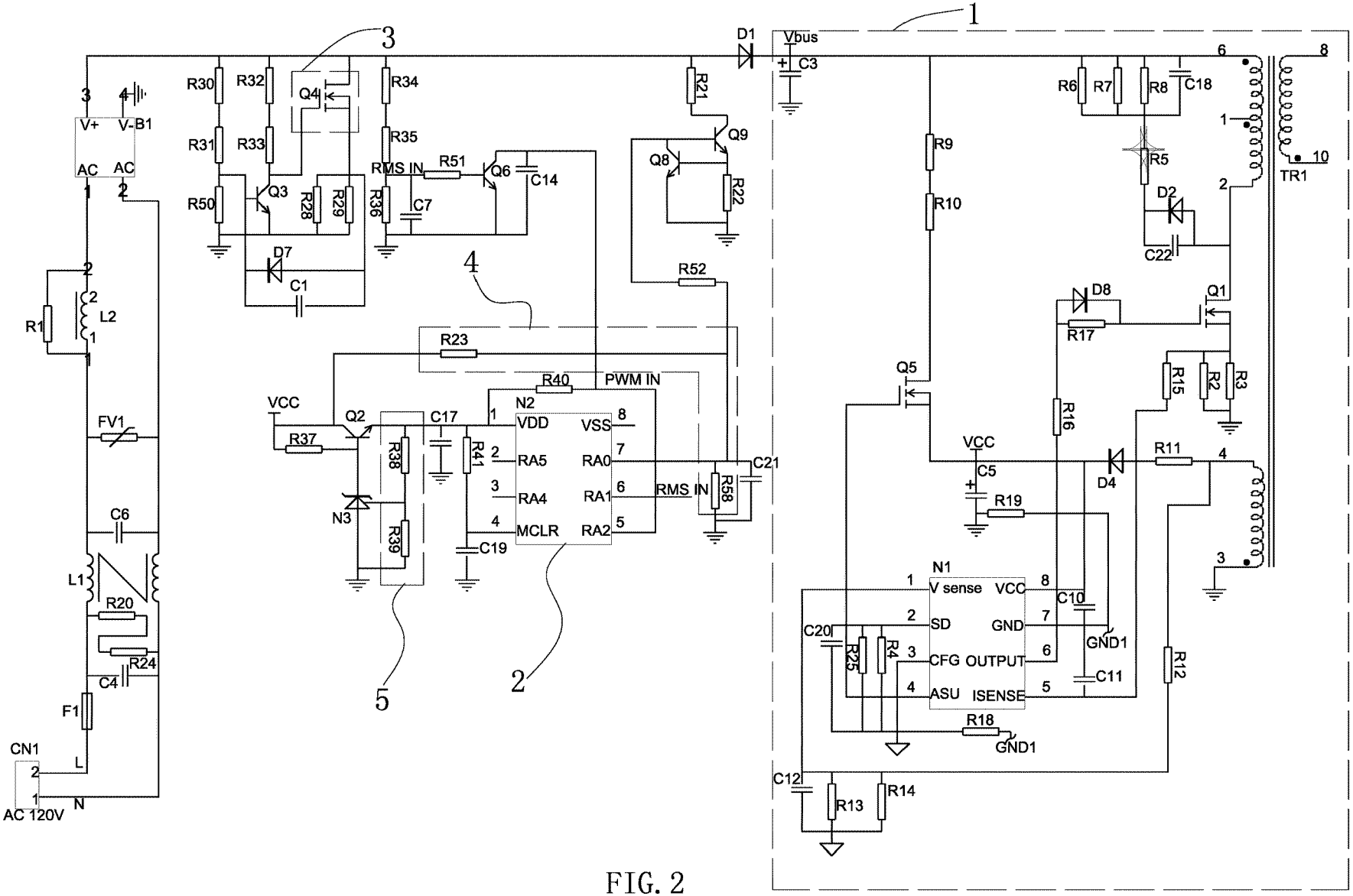
FIG. 2 is a partial circuit diagram corresponding to FIG. 1.
Figure 3:
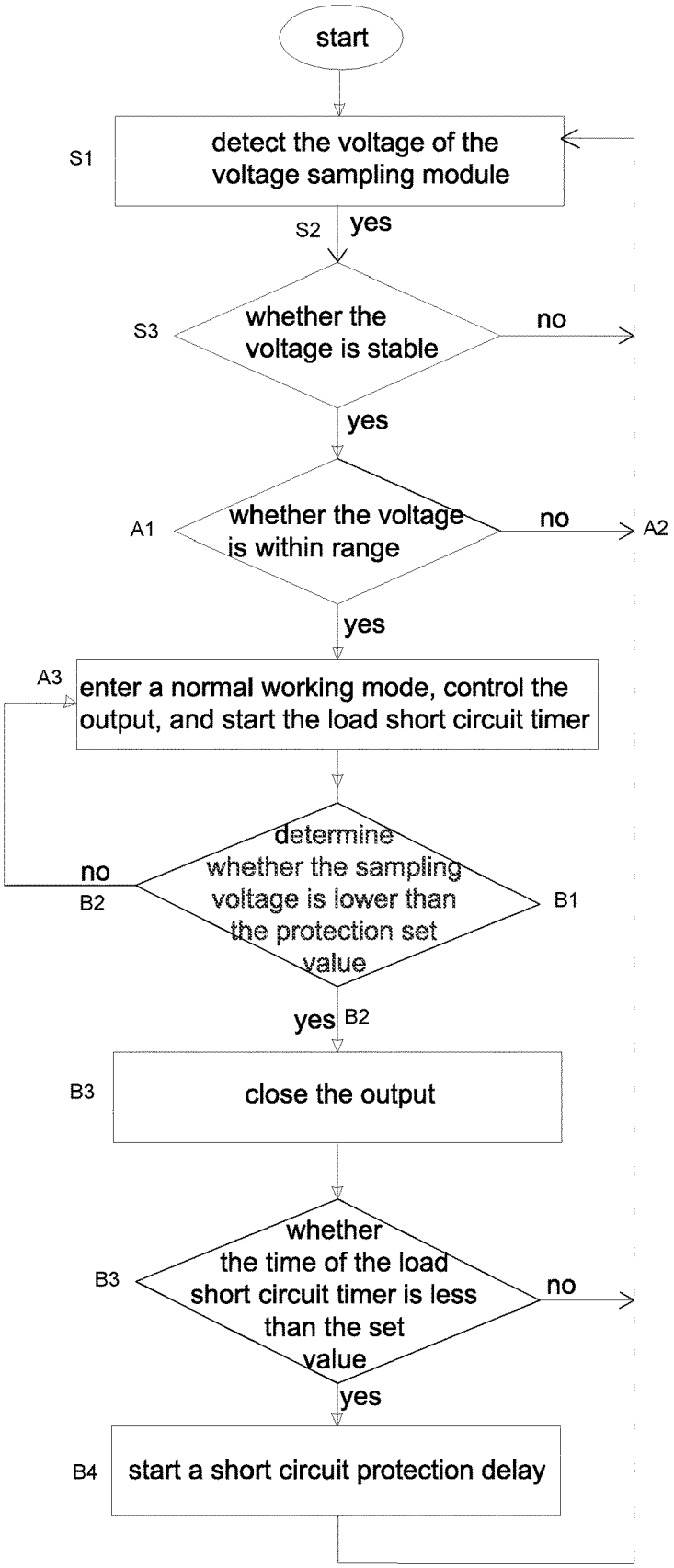
FIG. 3 is a flow chart of an embodiment of auxiliary monitoring method for intelligent power supply according to the present invention.

FIG. 1 and FIG. 2 show a structural schematic diagram of a intelligent power supply of the present application and a corresponding partial circuit diagram thereof, and FIG. 3 is a corresponding auxiliary monitoring method. It should be noted that, FIG. 1-3 shows only one case of the present application, and the present application may also be other structures that can implement the functions of the present application, which are all included in the scope of the present application. Only the situation shown in FIGS. 1-3 will be explained here.

As shown in FIG. 1, the intelligent power supply includes constant current/constant voltage module 1, dimming control module 2 which is located at the rear end of constant current/constant voltage module 1 and is electrically connected with it, and switch circuit 3 which is electrically connected with constant current/constant voltage module 1, and the switch circuit 3 is used to connect the constant current/constant voltage module 1 and load, which is controlled by the dimming control module 2.

The improvement of the present application is that a voltage sampling module 4 is further disposed between the constant current/constant voltage module 1 and the dimming control module 2. The power supply voltage of the voltage sampling module 4 is provided by the constant current/constant voltage module 1. The dimming control module 2 detects the voltage signal of the sampling resistance of the voltage sampling module 4 in real time, and the operating power of the dimming control module 2 is provided by the power supply voltage of the voltage sampling module 4.

The working voltage of the dimming control module is designed to be equal to the power supply voltage of the voltage sampling control, so that the power supply voltage of the dimming control module and the voltage sampling module are synchronously changed, and the dimming control module is in the standby mode when the circuit is started. preventing it from prematurely accessing the circuit and taking too much power from the constant current/constant voltage module, causing the constant current/constant voltage module to fail to start, causing the back end output to flicker, causing human body discomfort; the switch circuit is controlled by the dimming control module, and it can skillfully utilize that the dimming control module enters the standby mode due to insufficient working power supply caused by abnormal or unstable circuit, and the dimming control module cannot provide enough starting voltage to make the switching circuit conduct when the dimming control module is in standby mode, to prevent the switching circuit is always in the linear region when the circuit is abnormal, which leads to high power consumption and damage.

The voltage sampling module 4 includes at least two resistors connected in series. As shown in FIG. 2, in the embodiment, the voltage sampling module 4 includes first resistor R23 and second resistor R58 connected in series. A detection port of dimming control module 2 is connected between the first resistor R23 and the second resistor R58, for detecting the voltage drop of the second resistor R58, that is, the sampling resistor, according to the voltage drop and the ratio between the first resistor R23 and the second resistor R58, the power supply voltage of the current voltage sampling module 4 can be converted, so as to judge the current state of the circuit according to this information, and then the corresponding control mode is adopted, and the specific judgment process will be described in detail later.

In order to avoid the voltage drop instability on the sampling resistor, as shown in FIG. 2, filter capacitor C21 is connected in parallel at both ends of the second resistor R58.

At the same time, the working power supply end of the dimming control module 2 is connected to the power supply voltage end of the voltage sampling module 4 through the electrical branch formed by the stabilivolt N3 and the triode Q2. Specifically, the in-phase input end of the stabilivolt N3 is connected to the voltage dividing resistor branch 5 formed by resistor R38 and resistor R39, and the output end is connected to the power supply voltage end of the voltage sampling module 4 through the current limiting resistor R37, the negative pole is grounded. The base of the triode Q2 is connected to the output end of the stabilivolt N3, the collector is connected to the power supply voltage end of the voltage sampling module 4, and the emitter is connected to the working power supply end of the dimming control module 2. It is easily conceivable that the stabilivolt N3 is not only programmable precision reference TL431, but also may be zener diode.

In this embodiment, the constant current/constant voltage module 1 is an ACDC circuit, and the switch circuit 3 is composed of MOS transistor Q4 and other conventional devices, but it is easily conceivable that the constant current/constant voltage module is not only an ACDC module, and the switch circuit is not only composed of MOS, but also may be a bipolar transistor.

FIG. 3 shows an auxiliary monitoring method corresponding to the intelligent power supply of the present application. As shown in FIG. 3, the method includes, Step S1: the dimming control module detects whether the power supply voltage of the voltage sampling module reaches a stable value; here is consistent with the corresponding content of the foregoing structure, that is, the detection port of the dimming control module acquires the voltage obtained by the sampling resistance of the voltage sampling module, combined with the ratio of the resistance values of voltage sampling module, converting the obtained voltage to obtain a current power supply voltage of the voltage sampling module, and comparing the current power supply voltage with the stable value;

Step S1: If yes, step S3 is executed. If not, jump to step S1;

Step S3: Determine whether the power supply voltage of the voltage sampling module is stable and within a set range, and perform a corresponding operation.

specifically, in the S3, Determine whether the power supply voltage of the voltage sampling module is stable and within a set range, and perform a corresponding operation, specifically:

Step A1: If it is determined that the power supply voltage of the voltage sampling module is stable and within the set range, step A3 is performed;

Step A2: If it is determined that the power supply voltage of the voltage sampling module is unstable or not within the set range, then jump to step S1;

Step A3: The dimming control module enters a normal working mode, controls the output, and starts the load short circuit timer at the same time.

after the dimming control module enters the normal working mode, the method of the present application also performs the following operations.

Step B1: Continue to monitor the power supply voltage of the voltage sampling module to determine whether it is reduced to a predetermined value;

Step B2: If yes, perform step B3; if not, jump to step A3;

Step B3: the dimming control module controls the switch circuit to turn off, close the output, and determine whether the current time of the load short circuit timer is less than the set value, and if so, step B4 is performed, if not, then jump to step S1;

Step B4: Start a short circuit protection delay, and then jump to step S1.

Specific to the embodiment corresponding to FIG. 1 and FIG. 2, the corresponding specific process is:

First, the power supply of the dimming control module and the voltage sampling module comes from the Vcc of the ACDC control chip. At startup, the dimming control module is in standby mode, that is, the control chip operates in the standby mode, at this time, there is only a small standby current, and the ACDC starts normally.

The condition for the dimming control module to start working is the Vcc voltage has been stabilized and is within the set range—that is, the output voltage has been stabilized. In the startup phase of the circuit, the dimming control module is not accessed, that is, in the startup phase of the circuit, the dimming control module is in standby mode, which means that it does not play the role of the control circuit, that is, it does not have access to the circuit, which can prevent its premature access to the circuit to trigger the flashing of the lamp body. After the output loop is established, the dimming control module is re-accessed, that is, after the circuit is stabilized, the dimming control module enters the normal working state and plays the normal regulating role, so that the problem of output flicker can be avoided.

in normal operation, the dimming control module still monitors the Vcc voltage. When the output is overloaded or the output is shorted, the Vcc voltage drops. When Vcc falls to the set limit, the protection will be triggered, the switch circuit is on or off, that is, the circuit itself will set a threshold value and when the circuit runs for a period of time, the voltage will lose and the voltage will drop to less than or equal to the threshold value, the switch circuit will be closed, wherein the switch circuit consists of MOS transistor. like that the switch circuit formed by MOS Q4 is off, which then causes the ACDC circuit to be disconnected from the output end, that is, enters the short-circuit protection mode, and the dimming control chip makes a long time delay, and then re-detects and determines the Vcc voltage, and re-enters the working state. This avoids the problem that the output MOS transistor is always burned in the linear region due to the short circuit of the circuit.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An intelligent power supply includes:

a constant current/constant voltage module;

a dimming control module, which is located at a rear end of the constant current/constant voltage module and is electrically connected to the constant current/constant voltage module;

a switch circuit for electrically connecting the constant current/constant voltage module and a load, and the switch circuit is controlled by the dimming control module;

characterized in that:

the intelligent power supply further including a voltage sampling module disposed between the constant current/constant voltage module and the dimming control module;

a power supply voltage of the voltage sampling module is provided by the constant current/constant voltage module, and the dimming control module detects a voltage signal of a sampling resistance of the voltage sampling module in real time;

operating power for the dimming control module is provided by the power supply voltage of the voltage sampling module; wherein, a working power supply end of the dimming control module is connected to a power supply voltage end of the voltage sampling module through an electrical branch formed by a stabilivolt and a triode;

an in-phase input end of the stabilivolt is connected to a voltage dividing resistor branch, and an output end of the stabilivolt is connected to the power supply voltage end of the voltage sampling module through a current limiting resistor, and a negative pole is grounded;

a base of the triode is connected to the output end of the stabilivolt, a collector is connected to the power supply voltage end of the voltage sampling module, and an emitter is connected to the working power supply end of the dimming control module.

2. The intelligent power supply as claimed in claim 1 wherein the voltage sampling module includes at least two sampling resistors connected in series;

a detection port of the dimming control module is connected between the at least two serial sampling resistors for detecting a voltage drop of one of the sampling resistors.

3. The intelligent power supply as claimed in claim 1 wherein the constant current/constant voltage module is an alternating current/direct current (ACDC) circuit, and the switch circuit includes MOS transistor or a bipolar transistor.

4. The intelligent power supply as claimed in claim 2, wherein a filter capacitor is connected in parallel at both ends of one of the sampling resistors.

5. An auxiliary monitoring method for the intelligent power supply, using the intelligent power supply as claimed in claim 1, comprising:

step S1: detecting, via the dimming control module, whether the power supply voltage of the voltage sampling module reaches a stable value;

step S2: if the stable value is reached, step S3 is executed; if not, return to step S1;

step S3: determining, via the dimming control module, whether the power supply voltage of the voltage sampling module is stable and within a set range, and performing a corresponding operation.

6. The auxiliary monitoring method as claimed in claim 5, wherein in the step S3, executing via the dimming control module:

step A1: executing step A3 if the power supply voltage of the voltage sampling module is stable and within the set range;

step A2: returning to step S1 if the power supply voltage of the voltage sampling module is not stable or not within the set range;

step A3: entering, via the dimming control module, a normal working mode, controlling an output, and simultaneously starting a load short circuit timer.

7. The auxiliary monitoring method as claimed in claim 6, wherein the method further comprises performing following operations after proceeding to step A3, step B1: continuing to monitor the power supply voltage of the voltage sampling module to determine whether the power supply voltage is reduced to a predetermined value;

step B2: if the power supply voltage is reduced to the predetermined value, performing step B3; if not, returning to step A3;

step B3: controlling the switch circuit to turn off via the dimming control module, closing the output, and determining whether a current time of the load short circuit timer is less than the set value; if the current time is less than the set value, proceed to step B4; if the current time is not less than the set value, return to step S1;

step B4: starting a short circuit protection delay, and then returning to step S1.

8. The auxiliary monitoring method as claimed in claim 5, wherein determining whether the power supply voltage of the voltage sampling module is stable and within the set range further comprises:

acquiring an obtained voltage by a sampling resistor of the voltage sample module by a detection port of the dimming control module, converting the obtained voltage to obtain a current power supply voltage of the voltage sampling module, and comparing the current power supply voltage with the stable value.

* * * * *